United States Patent [19]

Osrow et al.

[11] 3,969,607

[45] July 13, 1976

[54] HAND STEAMING DEVICE WITH AUTOMATIC POWER INTERRUPTING MEANS

[75] Inventors: Leonard Osrow, Great Neck; Jacques L. LeBaigue, Westbury, both of N.Y.

[73] Assignee: Osrow Products Company Inc., Glen Cove, N.Y.

[22] Filed: June 18, 1974

[21] Appl. No.: 480,599

[52] U.S. Cl. ..... 219/272; 38/77.4; 68/222; 200/50 A; 219/284; 219/295; 239/136

[51] Int. Cl.[2] ..... H05B 1/02; H05B 3/60; D06F 75/08

[58] Field of Search ..... 219/284–295, 219/271–276, 437, 439; 68/222; 38/69, 77.1, 77.4, 77.8, 77.2, 77.82; 223/51; 21/117–119; 200/50 A, 61.58; 239/136

[56] References Cited

UNITED STATES PATENTS

| | | | |
|---|---|---|---|
| 1,717,040 | 6/1929 | Kaufman | 219/272 |
| 2,152,122 | 3/1939 | Wilcox | 219/288 X |
| 2,387,155 | 10/1945 | Katzman | 219/289 X |
| 3,579,263 | 5/1971 | Corbett et al. | 219/272 X |
| 3,690,024 | 9/1972 | Osrow | 68/222 X |
| 3,745,306 | 7/1973 | Naritomi | 219/272 |
| 3,755,649 | 8/1973 | Osrow | 219/288 X |

*Primary Examiner*—A. Bartis
*Attorney, Agent, or Firm*—Kirschstein, Kirschstein, Ottinger & Frank

[57] ABSTRACT

A hand steaming device includes a housing having a reservoir adapted to contain a quantity of water, a pair of spaced apart electrodes immersed in the water in the reservoir for generating steam upon passage of electrical current between the electrodes through the water and a switch connected in circuit with the electrodes for selectively controlling the energization of the electrodes from a source of electrical power. The reservoir is provided with a fill port and a removable fill cap seals the fill port. The cap is movable between a first position wherein it seals the port and a second position wherein the port is not sealed. Control means are cooperatively associated with the switch and the fill cap and arranged such that when the fill cap is in the second position the switch is automatically opened to prevent energization of the electrodes and when the fill cap is in the first position the switch can be selectively closed to energize the electrodes or open to de-energize the electrodes as desired.

8 Claims, 5 Drawing Figures

HAND STEAMING DEVICE WITH AUTOMATIC POWER INTERRUPTING MEANS

BACKGROUND OF THE INVENTION

1. Field of the Invention

Hand steamers

2. Description of the Prior Art

Portable hand held steamers have been used for many years for performing pressing and/or steaming function. Many portable hand held steamerscontain a pair of electrodes which are immersed in an electrolytic solution. A current passes between the electrodes generating sufficient heat so that the electrolytic solution is converted into steam. The hand steamer contains a steam discharge area through which the steam is discharged and from which said steam is directed against the item to be pressed and/or steamed.

As steam continues to form the quantity of electrolytic solution is depleted so that after a while a need for replenishment arises. Usually this involves adding water to the reservoir of the hand steamer.

Most hand steamers of the type using a pair of spaced apart electrodes include a fill cap which is removable. Upon removing the fill cap, water is added to the reservoir through a fill port when replenishment of the electrolytic solution is required. It is imperative that when water is being added to the steamer for replenishment of the electrolytic solution that there be no electrical potential applied to the electrodes.

One reason for this is that when a person is adding water to the hand steamer quite often more water will be added to the reservoir than the reservoir is able to accept so that there will be a spill over into a fill cap well. If there is a flow of electrical current between the electrodes this can present a problem if the person's fingers come in contact with the water which the reservoir is unable to accept in the fill cap well. It is also desirable that there be no electrical current flowing between the electrodes when the fill cap is removed in case a person inadvertently extends a metal object into the electrolytic solution.

Thus it is desirable to make sure than when water is being added to the hand steamer to replenish the electrolytic solution that there is an automatic interruption in the supply of power to the hand steamer electrodes.

SUMMARY OF THE INVENTION

1. Purposes of the Invention

It is an object of the present invention to provide an improved hand steaming device.

Another object of the present invention is to provide an improved hand steaming device which is safe to operate.

Still another object of the present invention is to provide an improved hand steaming device wherein the supply of power to the hand steaming device electrodes is automatically interrupted upon water being added to the hand steaming device reservoir upon the cap being removed from the fill cap port to replenish the electrolytic solution contained therein.

Still another object of the present invention is to provide an improved hand steaming device capable of achieving the foregoing objects and which is simple to operate and reliable in operation.

Other objects of the invention will in part be apparent and in part will be pointed out hereinafter.

2. Brief Description of the Invention

According to the present invention, the foregoing as well as other objects which will be apparent to those skilled in the art are accomplished by a hand steamer which includes a plastic housing and within said housing an electrolyte reservoir. Located within said reservoir are a pair of spaced apart electrodes. Located in said housing directly above said reservoir is a fill port. Above the fill port is a fill well. A fill cap seats in said fill well for sealing said fill port and is affixed to a lever. Movable with said fill cap is a cam. The lever is provided to rotate the cap and cam as will hereinafter be described.

An electric switch is provided. The electric switch has two operating conditions. In the first operating condition of the electric switch electrical power is directed to the electrodes upon the hand steaming device being connected to a source of electrical power. In the second condition of the electric switch the flow of electrical power to the electrodes is interrupted.

A plunger is provided which controls the operation of the electric switch. The plunger includes two positions. In the first position of the plunger the electric switch is in the first condition and in the second position of the plunger the electric switch is in the second condition. Means biases the electric switch plunger to its second position.

The hand steamer includes a handle and as a part thereof is a cam overhang beneath which the cam can be selectively positioned when the fill cap is in the fill well. When the fill cap is rotated by the lever so that the cam is under the overhang, the cam, in one of its positions, abuts the plunger causing the plunger to be placed in the first position so that electrical power is directed to the electrodes resulting in the conversion of the electrolytic solution to steam. With the cam in this position, it is impossible to remove the fill cap from the fill well by lifting said fill cap from said fill cap well to add water to the reservoir through the fill port for replenishment purposes. This is because the overhang prevents the cam and hence fill cap from being lifted away from the housing.

If it is desired to stop power from being directed to the electrodes the lever is rotated so that the cam is still beneath the overhang but in a position such that the cam does not maintain the switch plunger in the first position. As a result, the switch plunger under the influence of the biasing means is in the second position and there is no electrical power directed to the electrodes.

When it is desired to replenish the electrolytic solution the lever is rotated so that the cam is no longer under the overhang and the fill cap is removed from the fill well exposing the fill port. Since the cam does not now act on the switch plunger the plunger is in the second position and no electrical power is directed to the electrodes. Water is then added to the electrolytic reservoir through the fill port. There is no danger of accidents since there is no electrical power directed to the electrodes when the fill port is exposed.

The invention accordingly consists in the features of construction, combination of elements and arrangement of parts which will be exemplified in the device hereinafter described and of which the scope of application will be indicated in the appended claims.

DESCRIPTION OF THE PREFERRED EMBODIMENTS

Figure 1:
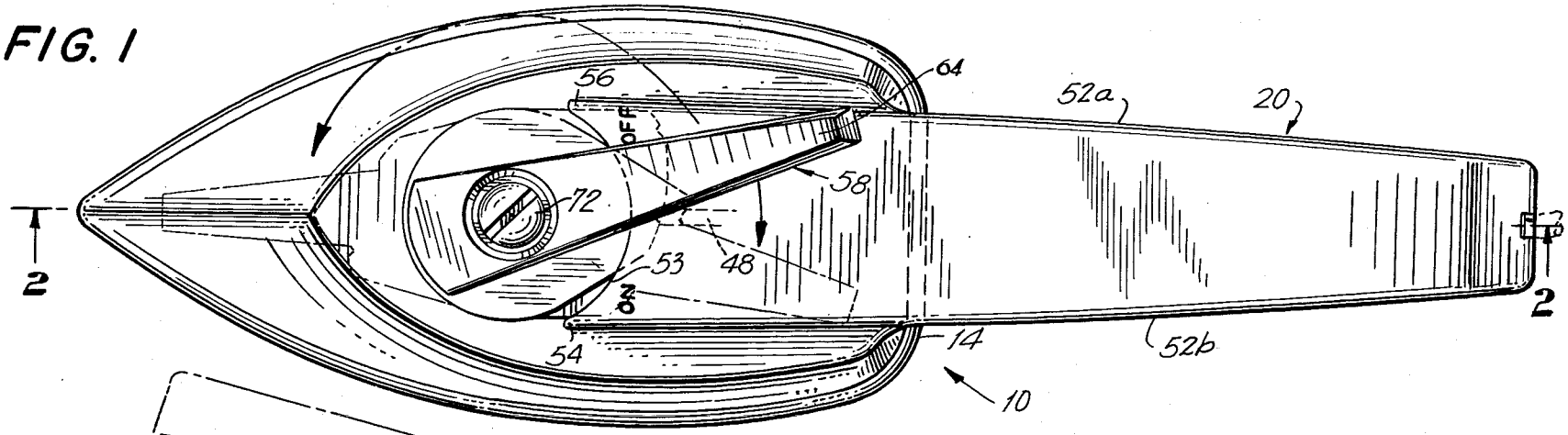
FIG. 1 is a top plan view of a hand steamer according to the present invention.

In the drawings a hand steamer 10 according to the present invention is shown and includes a housing 12. Housing 12 can be constructed from a conventional plastic material as will be apparent to those skilled in the art. Housing 12 includes a base section 14 within which is formed an electrolytic reservoir 16. Located at the bottom of base 14 is a flange 18 to which is attached a sole plate 21. A steam discharge port is located in sole plate 21. The specific structure of the sole plate does not form a part of the present invention and for information concerning the design of a suitable sole plate reference is made to U.S. Pat. No. 3,690,024.

A handle 20 is provided and extends rearwardly from base 14. A wall 22 is located over reservoir 16 and depending downwardly therefrom is a fill cap well 24 formed by a cylindrical wall section 26. Located at the bottom of fill cap well 24 is a slot 28 which serves a function that will hereinafter be apparent.

Located in handle 20 is a momentary normally open switch 32. Normally open momentary switch 32 is located within a housing 34 which is made from a suitable plastic non-conducting material. Housing 34 includes a top wall 36, side walls 38 and 40 and a front wall 42. In addition, a rear wall 46 is provided.

The precise structure of momentary normally open switch 32 is not set forth herein since it is conventional.

Switch 32 includes an actuating plunger 48 which extends through wall 42. A stepped boss 50 is located on wall 42. Wall 42 and boss 50 include aligned registered openings through which plunger 48 (switch control element) extends. Switch 32 includes a biasing means which keeps plunger 48 in an extended condition, i.e. a condition such that absent an external force being applied to the plunger, the plunger is in a position so that the left tip thereof is at least a predetermined distance from boss 50.

Figure 2:
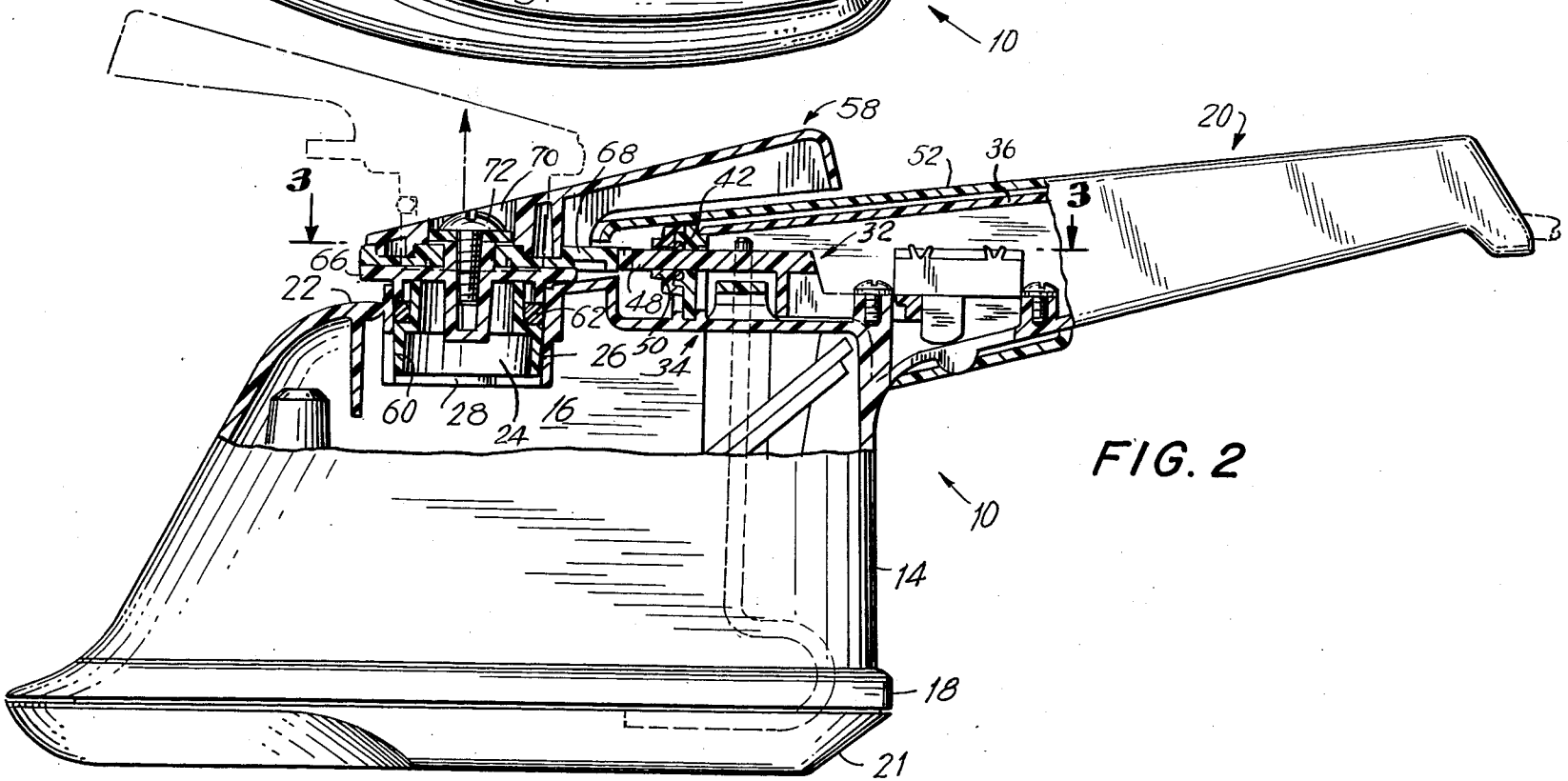
FIG. 2 is a sectional view taken substantially along the line 2—2 of FIG. 1.
Figure 3:
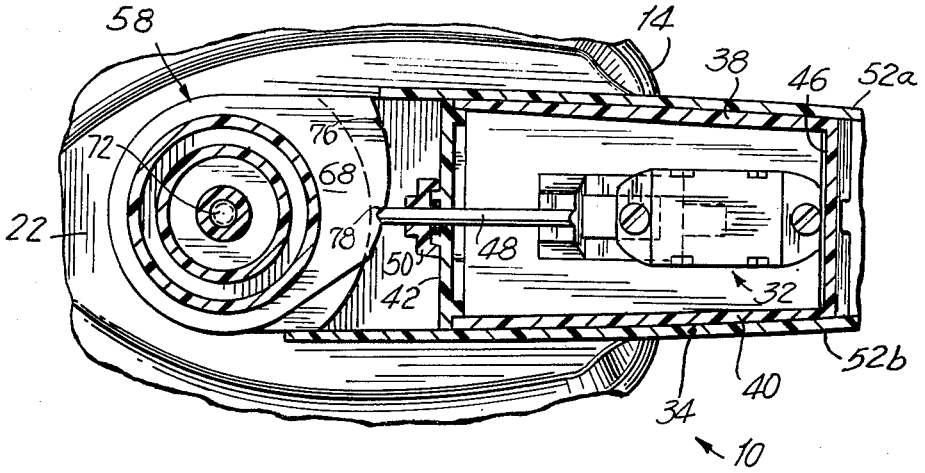
FIG. 3 is a sectional view taken substantially along the line 3—3 of FIG. 2.
Figure 4:
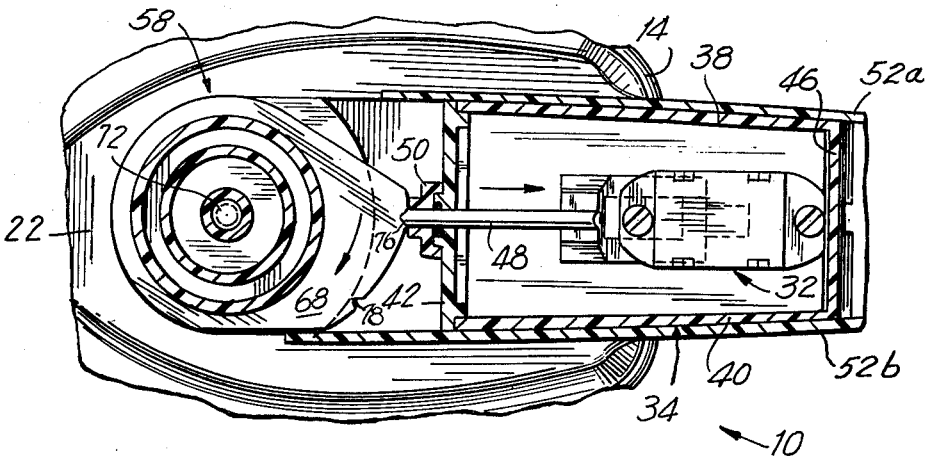
FIG. 4 is a sectional view taken substantially along the line 3—3 of FIG. 2 with the switch plunger being depressed so that electrical power is directed to the hand steamer electrodes.

Hand steamer 10 includes a pair of electrodes, one of which can be seen in FIG. 2. The electrodes are parallel to each other and spaced apart from each other as is conventional. A wire and plug are connected to switch 32. Switch 32 controls the flow of electric current to the hand steamer electrodes which are connected to said switch. When plunger 48 is extended the switch is in its normally open condition and there is no flow of electric current to the electrodes of the hand steamer when a source of electrical power is connected to switch 32. On the other hand, when the plunger is retracted, i.e. the bias of the switch spring is overcome by moving the plunger to the right of the position shown in FIG. 3, the switch is closed so that electrical current can be directed to the electrodes.

A handle cover 52 is affixed to the top of handle 20 and overlays the switch housing. Handle cover 52 is flat and includes flanges **52*a* and 52b on its opposed sides which flank a portion of the switch housing with the bottom of each flange being affixed to the handle. Handle cover 52 includes a rounded frontward portion 53 which is spaced slightly to the right of fill cap well 24 for the orientation shown in FIGS. 1 through 4. The left portion (hereinafter called the overhang) of handle cover 52 overlays the portion of plunger 48 to the left of boss 50 at all times and includes a circular edge 53. The handle cover flanges 52*a* and 52*b* flank the portion of said plunger which is to the left of boss 50 at all times. The words "on" and "off" appear at opposite sides of the handle cover adjacent cusps 54 and 56,** respectively.

Figure 5:
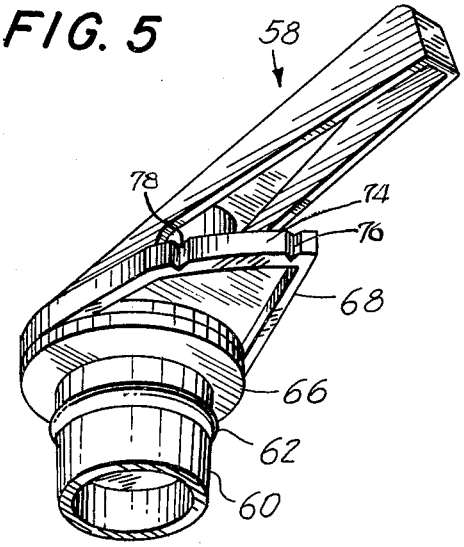
FIG. 5 is a perspective view of the fill cap lever structure of the hand steamer of the present invention.

A combined lever fill cap cam structure 58 shown in perspective in FIG. 5 includes a fill cap 60. Fill cap 60 is selected to be of a size such that it seats in fill cap well 24 overlaying slot 28. At the upper portion of fill cap 60 is a groove in which an O-ring 62 is seated. When the fill cap is received within fill cap well 24 O-ring 62 is slightly below the upper lip of the wall which defines fill cap well 24 (see FIG. 2). A circular flat plate 66 is located at the upper portion of fill cap 60.

Integral with a lever 64 is a flat cam plate 68 (switch element control member). Lever 64 includes a counterbore 70 and flat cam plate 68 includes a bolt clearance hole. A screw 72 has its head received in counterbore 70, extends through the bolt clearance hole in cam plate 68 and is in threaded engagement with a tapped hole in fill cap 60. Cam plate 68 includes a cam surface 74 which includes notches 76 and 78. Cam plate 68 is generally elliptical in shape with the cam surface being beneath lever 64. The portion of cam plate 68 spaced from cam surface 74 and overlaying plate 66 is circular having the same radius as said plate 66 and being in registry therewith.

When fill cap 60 is received in fill cap well 24 cam surface 74 is beneath the overhang of handle cover 52 when lever 64 overlays the handle cover.

In normal operation fill cap 60 is received in fill cap well 24 and cam surface 74 is beneath the overhang. With lever 64 over the word "off" plunger 48 is received in notch 78. Because of the shape of cam surface 74 the plunger is in its extended position so that switch 32 is open and there is no electrical current being direced to the electrodes. On the other hand, when it is desired to have electrical current directed to the electrodes lever 64 is rotated so that the lever overlays the word "on". As this is occurring, the tip of plunger 48 slides from notch 78 along cam surface 74 into notch 76. Because of the shape of the cam surface the plunger is now retracted so that the switch is closed and electrical current is directed to the electrodes converting the electrolyte into steam.

When it is desired to add water to reservoir 16 lever 64 is rotated in a counterclockwise direction looking down at the steamer as shown in FIG. 1 past cusp 56 until cam plate 68 is no longer beneath the overhang. When this occurs, the lever is elevated removing fill cap 60 from fill cap well 24 exposing slot 28. Water can then be added to reservoir 16 through slot 28 replenishing the quantity of electrolytic solution in the reservoir. Inasmuch as there is nothing to maintain plunger 48 retracted, switch 32 is open and there is no electrical power directed to the electrodes. Thus, it is inherent that when fill cap 60 is removed from fill cap well 24 to add water to reservoir 16 switch 32 is opened.

After reservoir 16 has been filled fill cap 60 is placed in fill cap well 26 with lever 64 slightly spaced from a position of overlaying cusp 56 of any portion of handle cover 52. The lever is then rotated in a clockwise direction for the orientation of the hand steamer shown in FIG. 1 so that cam plate 68 is beneath the overhang. If it is not desired to commence steaming operations, the lever is rotated so that it overlays the word "off" whereas if it is desired to commence steaming operations the lever is rotated to overlay the word "on".

The only way to remove the fill cap from fill cap well 24 is functions. rotate lever 64 in steamers contain counter clockwise direction with the hand steamer positioned as shown in FIG. 1 past the word "off" so that cam plate 68 is no longer beneath the overhang.

It is to be appreciated that flange 52*a* includes a cutaway beneath cusp 56 to permit the cam plate to pass beneath the overhang as lever 64 is rotated past the word "off" on handle cover 52 in a counterclockwise direction. There is no such cutaway on flange 52*b* so that lever 64 cannot be rotated in a clockwise direction with the steamer positioned as shown in FIG. 1 past the word "on" since the cam plate will abut flange 52*b*.

It thus will be seen that there is provided a hand steaming device with automatic power interrupting means which achieves the various objects of the invention and which is well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense.

Having just described the invention, there is claimed as new and desired to be secured by Letters Patent:

1. A hand steaming device comprising a housing, said housing including a reservoir, a pair of spaced apart electrodes located in said reservoir, a fill cap port through which a liquid can be directed to said reservoir, a fill cap for sealing said fill cap port and movable between a position wherein said fill cap seals said fill cap port to a position wherein said fill cap does not seal the fill cap port, said fill cap rotatable in said fill cap port while sealing said fill cap port, switch means connected to said electrodes, and means cooperatively associated with said switch means and said fill cap for selectively controlling the operation of said switch means in response to rotation of said fill cap in said fill cap port and so that when said fill cap is positioned so that it no longer seals said fill cap port said switch means is opened to prevent a source of electrical power which is connected to said switch means from being connected to said electrodes and so that when said fill cap seals said fill cap port said switch means can selectively be closed to connect the source of electrical power to said electrodes and alternatively selectively be opened to prevent said source of electrical power from being connected to said electrodes.

2. A hand steaming device according to claim 1 wherein said selective control means includes a switch control element movable between a first position and a second position, said switch control element in said first position preventing said switch means from connecting the source of electrical power which is connected to said switch means to said electrodes and in said second position allowing said switch means to connect the source of electrical power to said electrodes, said selective control means further including means operatively associated with said fill cap for selectively placing said switch control element in said second position when said fill cap seals said fill cap port.

3. A hand steaming device according to claim 2 wherein said switch control element is biased to its first position.

4. A hand steaming device according to claim 2 wherein said means for selectively placing said switch control element in said second position when said fill cap seals said fill cap port is integral with said fill cap.

5. A hand steaming device according to claim 4 wherein said means for selectively placing said switch control element in said second position when said fill cap seals said fill cap port includes a switch control element control member.

6. A hand steaming device according to claim 5 wherein said fill cap is removable from said fill cap port and means integral with said housing prevents said fill cap from being removed from said fill cap port for certain orientations of said switch control element control member relative to housing.

7. A hand steaming device according to claim 6 wherein said means integral with said housing includes a fill cap removal preventing overhang spaced above said switch control element control member when said fill cap seals said fill cap port for certain orientations of said switch control element control member relative to said housing.

8. A hand steaming device comprising a housing, said housing including a reservoir, a pair of spaced apart electrodes located in said reservoir, a fill cap port through which a liquid can be directed to said reservoir, a fill cap for sealing said fill cap port and movable between a first position wherein it seals said fill cap port and a second position wherein the fill cap port is no longer sealed, switch means connected to said electrodes, and means cooperatively associated with said switch means and said fill cap for selectively controlling the operation of said switch means in response to movement of said fill cap between said first and second positions such that when said fill cap is in the position wherein it no longer seals said fill cap port said switch means is opened to prevent a source of electrical power which is connected to said switch means from being connected to said electrodes and so that when said fill cap is in the position wherein it seals said fill cap port said switch means can selectively be closed to connect the source source of electrical power to said electrodes and alternatively can selectively be opened to prevent said source of electrical power from being connected to said electrodes.

* * * * *